US006196636B1

(12) United States Patent
Mills et al.

(10) Patent No.: US 6,196,636 B1
(45) Date of Patent: Mar. 6, 2001

(54) CUTTING BIT INSERT CONFIGURED IN A POLYGONAL PYRAMID SHAPE AND HAVING A RING MOUNTED IN SURROUNDING RELATIONSHIP WITH THE INSERT

(75) Inventors: Ronald D. Mills, Yorba Linda, CA (US); Larry J. McSweeney, 3460 Co. Rd. 15; Lawrence H. McSweeney, 3788 Co. Rd. 15, both of South Point, OH (US) 45680

(73) Assignees: Larry J. McSweeney; Lawrence H. McSweeney, both of South Point, OH (US)

( * ) Notice: Subject to any disclaimer, the term of this patent is extended or adjusted under 35 U.S.C. 154(b) by 0 days.

(21) Appl. No.: 09/274,451

(22) Filed: Mar. 22, 1999

(51) Int. Cl.[7] ..... E21C 35/183

(52) U.S. Cl. ..... 299/111; 299/110; 299/104; 299/113

(58) Field of Search ..... 299/110, 111, 299/104, 113; 37/465, 452, 454

(56) References Cited

U.S. PATENT DOCUMENTS

| | | | | |
|---|---|---|---|---|
| 3,356,418 | * | 12/1967 | Healey et al. | 299/113 |
| 3,361,481 | | 1/1968 | Maddock . | |
| 3,746,396 | | 7/1973 | Radd . | |
| 3,833,264 | * | 9/1974 | Elders | 299/110 |
| 4,201,421 | | 5/1980 | Den Besten et al. . | |
| 4,489,986 | | 12/1984 | Dziak . | |
| 4,497,520 | | 2/1985 | Ojanen . | |
| 4,547,020 | | 10/1985 | Ojanen . | |
| 4,561,698 | | 12/1985 | Beebe . | |
| 4,660,890 | | 4/1987 | Mills . | |
| 4,725,098 | | 2/1988 | Beach . | |
| 4,725,099 | | 2/1988 | Penkunas et al. . | |
| 4,823,454 | | 4/1989 | Mills . | |
| 4,911,503 | | 3/1990 | Stiffler et al. . | |
| 4,932,723 | | 6/1990 | Mills . | |
| 4,938,538 | | 7/1990 | Larsson et al. . | |
| 4,940,288 | | 7/1990 | Stiffler et al. . | |
| 4,941,711 | | 7/1990 | Stiffler . | |
| 5,131,725 | | 7/1992 | Rowlett et al. . | |
| 5,161,859 | | 11/1992 | Larsson et al. . | |
| 5,219,209 | * | 6/1993 | Prizzi et al. | 299/111 |
| 5,324,098 | | 6/1994 | Massa et al. . | |
| 5,417,475 | | 5/1995 | Graham et al. . | |
| 5,484,191 | | 1/1996 | Sollami . | |
| 5,551,760 | | 9/1996 | Sollami . | |
| 5,823,632 | * | 10/1998 | Burkett | 299/104 |
| 6,019,434 | * | 2/2000 | Emmerich | 299/111 |

FOREIGN PATENT DOCUMENTS

| | | | | |
|---|---|---|---|---|
| 870701 | * | 10/1981 | (RU) | 299/111 |

* cited by examiner

*Primary Examiner*—David Bagnell
*Assistant Examiner*—Sunil Singh
(74) *Attorney, Agent, or Firm*—James H. Foster; Kremblas, Foster, Millard & Pollick

(57) ABSTRACT

A cutting tool configuration includes a cutting bit insert configured in the shape of an octagonal pyramid. The cutting bit insert includes a number of portions, each of which has faces which slope at different angles with respect to the longitudinal axis of the cutting bit insert. The cutting bit insert also includes a flange which is surrounded by a ring. The ring is softer than the cutting bit insert.

14 Claims, 2 Drawing Sheets

CUTTING BIT INSERT CONFIGURED IN A POLYGONAL PYRAMID SHAPE AND HAVING A RING MOUNTED IN SURROUNDING RELATIONSHIP WITH THE INSERT

BACKGROUND OF THE INVENTION

1. Field of the Invention

The present invention relates generally to a cutting tool, and more particularly to a cutting bit insert and ring of the type for fixing to a rotable shank where the bit insert is a polygonal pyramid and the bit insert is harder than the ring.

2. Description of the Related Art

Various types of configurations have been used in the past for the bits of abrading or cutting instruments. It is conventional in the art to attach a cutting bit insert made of a blended material, which includes some tungsten carbide, to one end of a shank and to then insert the shank into a block. The block is then pushed along a surface, the force of the surface on the cutting bit insert causing rotation of the bit insert and shank and abrasion or cutting of the surface. The use of this general configuration is old in the art.

Many of the modifications of this general configuration have been made to the cutting bit insert and to the geometry of the juncture between the bit insert and the shank. Examples of these types of modifications can be found in the patents to Den Besten et al., U.S. Pat. No. 4,201,421; Ojanen, U.S. Pat. Nos. 4,497,520 and 4,547,020; Penkunas et al., U.S. Pat. No. 4,725,099; Mills, U.S. Pat. Nos. 4,823,454 and 4,932,723; Stiffler et al., U.S. Pat. Nos. 4,911,503 and 4,940,288; Larsson et al., U.S. Pat. Nos. 4,938,538 and 5,161,859; and Stiffler, U.S. Pat. No. 4,941,711.

Other modifications have been made to the cutting bit insert itself by including radially extending ribs along a portion of the cutting bit insert. Examples of this type of modification can be found in the patents to Maddock, U.S. Pat. No. 3,361,481; Radd, U.S. Pat. No. 3,746,396; Rowlett et al., U.S. Pat. No. 5,131,725; Massa et al., U.S. Pat. No. 5,324,098; and Sollami, U.S. Pat. Nos. 5,484,191 and 5,551,760.

Other modifications have been made to the shank, the block, or the joints between the cutting bit insert and the shank or the shank and the block. These modifications have been designed to increase the durability of the various parts and keep them from deteriorating over time from abrasive contact with the asphalt. Examples of structures which attempt to increase durability are shown in the patents to Dziak, U.S. Pat. No. 4,489,986; Beebe, U.S. Pat. No. 4,561,698; Mills, U.S. Pat. No. 4,660,890; Beach, U.S. Pat. No. 4,725,098, and Graham et al., U.S. Pat. No. 5,417,475.

However, even though there have been numerous designs created and previously used, it is desirable that an improved configuration be used which further increases the abrasion properties of the bit while decreasing the erosion of the remainder of the structure. The present invention is an improvement in this area and includes these and other important features.

SUMMARY OF THE INVENTION

The present invention relates to the configuration of a cutting tool. The cutting tool includes a shank, a cutting bit insert, and a protective ring. The cutting bit insert and the ring are of the type for fixing to the rotatable shank.

The cutting bit insert has a plurality of integrally formed portions. The portions are configured in a polygonal pyramid shape, and there are preferably first, second, and third portions. The polygonal pyramid is provided with a selected number of faces and is preferably octagonal. Adjacent ones of the faces of the pyramid meet at common edges. These common edges intersect at a vertex which forms one end of the cutting bit insert. The faces of the first portion slope away from the vertex at a first angle relative to a longitudinal axis of the cutting bit. The faces of the second portion slope away from the first portion at a second angle relative to the longitudinal axis. In a preferred embodiment, the faces of the third portion slope away from the second portion at a third angle relative to the longitudinal axis.

The cutting bit insert also includes a flange which extends outwardly from the faces of one of the portions, preferably the third portion. A protective ring is mounted in surrounding relationship to the flange. The bit insert has a first hardness and the ring has a second hardness lower than the first hardness.

Figure 1:
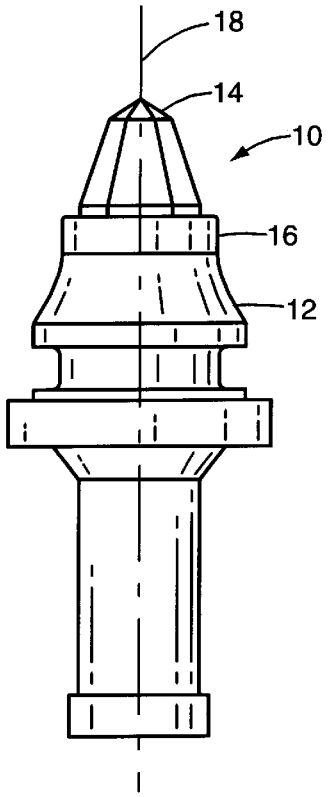
FIG. 1 is a side view of a cutting tool according to the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art. Those skilled in the art will also recognize that there are many, and in the future may be additional, alternative elements which are recognized as equivalent to the elements described therein because they provide the same operations.

DETAILED DESCRIPTION OF THE INVENTION

The present invention relates to a configuration of a cutting tool 10, which is illustrated in FIG. 1. The cutting tool 10 includes a shank 12, a cutting bit insert 14, and a ring 16. These parts are all aligned along a common longitudinal axis 18. The shank 12 is designed to be inserted into a block (not shown) and pushed along a surface (not shown), as is conventional in the art. When the cutting bit insert 14 is pushed along the surface, it will tend to rotate and abrade or cut the surface, thereby removing loosened material from the surface.

Figure 4:
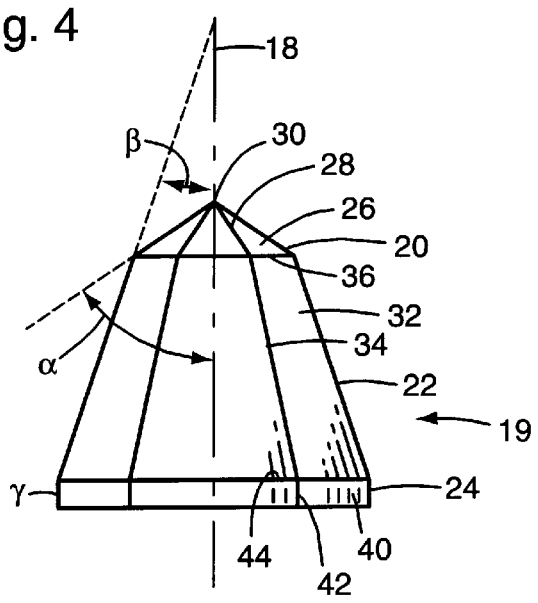
FIG. 4 is a side view of the cutting bit insert.
Figure 5:
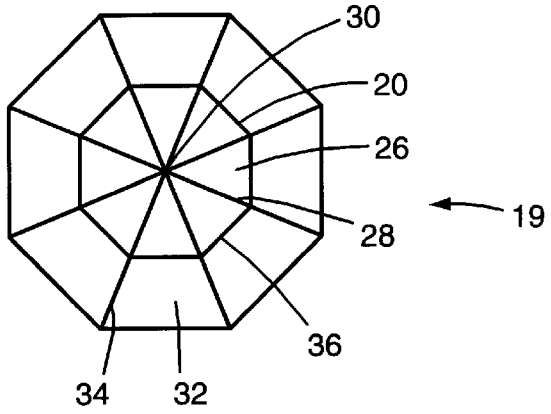
FIG. 5 is a top view of the cutting bit insert.

Turning first to FIGS. 4 and 5, the body 19 of the cutting bit insert 14 is seen in greater detail. The cutting bit insert 14 has a body 19 which is made up of a number of integrally formed and aligned portions 20, 22, 24 which are together configured in the shape of a polygonal pyramid. The polygonal pyramid has eight faces 26 on the first portion 20. Adjacent ones of the faces 26 meet at common edges 28. The edges 28 intersect at a vertex 30 which is centered on the body 19 and through which the longitudinal axis 18 runs. The vertex 30 forms one end of the cutting bit insert 14. The faces 26 slope away from the vertex 30 at a first angle $\alpha$ relative to the longitudinal axis 18 of the cutting bit insert 14. The first angle $\alpha$ is about 56° in a preferred embodiment.

The second portion 22 of the body 19 is preferably integrally formed with the first portion 20 of the body 19. The second portion 22 is aligned with the first portion 20 along the longitudinal axis 18. The second portion 22 continues the polygonal pyramid shape of the first portion 20, and thus the faces 26 and edges 28 of the first portion 20 continue along the second portion 22 as the faces 32 and edges 34 of the second portion 22. However, at the boundary 36, which is merely a line of demarcation between the first portion 20 and the second portion 22, since the portions 20, 22 are integrally formed, the faces 32 of the second portion 22 change slope. The faces 32 of the second portion 22 slope at a second angle $\beta$ with respect to the longitudinal axis 18 of the cutting bit insert 14. As seen in the drawings, the second angle $\beta$ is shown as being the angle between one of the faces 32 of the second portion 22 and a line 38 which is parallel to the longitudinal axis 18. As a basic geometric principle, the angle between the faces 32 of the second portion 22 and the line 38 is the same as the angle between the faces 32 of the second portion 22 and the longitudinal axis 18. In the preferred embodiment shown, the second angle $\beta$ is about 15°.

As particularly shown in FIG. 4, a third portion 24 is integrally formed with the first and second portions 20, 22 and aligned with the first and second portions 20, 22 along the longitudinal axis 18. The third portion 24 continues the polygonal pyramid shape of the first and second portions 20, 22 and thus the faces 32 and 34 of the second portion 22 continue along the third portion 24 as the faces 40 and edges 42 of the third portion 24. However, at the boundary 44, which is merely a line of demarcation between the second portion 22 and the third portion 24, since the portions 20, 22, 24 are integrally formed, the faces 40 of the third portion 24 change slope. The faces 40 of the third portion 24 slope at a third angle $\gamma$ with respect to the line 46 and therefore to the longitudinal axis 18 of the cutting bit insert 14, as explained above. In the preferred embodiment shown, the third angle $\gamma$ is preferably very small, and most preferably is about 0°.

It is preferred that the cutting bit insert 14 be made of a material which is a particular blend of tungsten carbide. Cutting bit inserts are, as a rule, made from materials which include tungsten carbide as a component. The most preferred composition includes around 93.8% tungsten carbide, about 6% cobalt, and about 0.02% tantalum carbide, by weight. This composition is preferably made from a homogenous grain distribution with an average grain size between about 0.8 microns and about 1.2 microns. This combination gives a grade of carbide which has a hardness of about 91 Ra, a density of about 14.7 grams per cubic centimeter, a TRS of 1550 Newtons per square millimeter and a porosity of A04, B00, C00. This composition is preferred for the cutting bit insert 14 of the present invention and yields a cutting bit insert which is capable of adequately performing its purpose.

The present cutting bit insert 14 has a variety of improved characteristics due to these disclosed features. First, the use of the faces 26 on the first portion 20 of the cutting bit insert 14 enhances the rotational vector forces applied to the cutting bit insert 14 as compared to a smooth surface on a corresponding portion used in prior art cutting bit inserts. Providing this pyramid shape to the first portion 20 effects a more consistent degree of rotation of the shank 12 which leads to a more consistent cutting of the surface. In addition, the extension of the faces and edges the full length of the body 19 increases the strength of the nose or end portion 20 of the present cutting bit insert 14 over prior art cutting bits which have faces which extend only a portion of the way along the body.

Modifications to the preferred embodiment may be made without departing from the spirit of the invention. The preferred embodiment has an octagonal pyramid configuration. However, other polygonal pyramid configurations, such as heptagonal or nonagonal pyramids, could also be used. What is important is that the faces and edges extend substantially the full length of the body with the edges intersecting at the vertex, regardless of the particular number of faces. In the preferred embodiment, the cutting bit insert includes three integrally formed and aligned portions. However, the use of three portions particularly is not critical. It is important that the cutting bit include at least two portions which slope at different angles, but there need not be any more than two portions. In addition, a fourth portion which slopes at yet another angle with respect to the longitudinal axis may be included. If the fourth portion is to be added, it is preferable that the additional portion be inserted between the first and second portions or between the second and third portions, since it is also preferred that the angle of the slope gradually decrease from the vertex to the final portion and that the portions be arranged to conform to this desirable sloping. It is also preferred that regardless of the number of portions, that the angle of slope of the portion furthest from the vertex be very small or zero to enable the ring, which is disclosed in greater detail below, to more easily fit around and be properly placed in relation to this portion and for ease and economy of manufacture.

Figure 6:
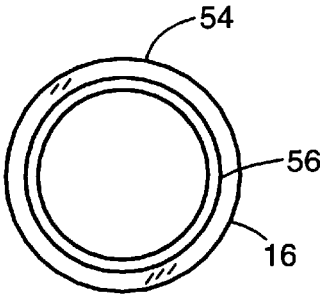
FIG. 6 is a top view of the ring.
Figure 7:
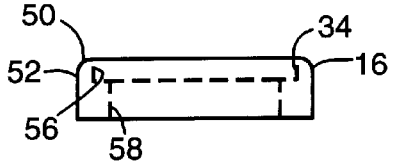
FIG. 7 is a side view of the ring.

Turning now to FIGS. 6 and 7, the protective ring 16 is shown in greater detail. The ring 16 has a curved outer surface 50 on its upper portion 52. The ring 16 also includes a bore 54 configured to permit the cutting bit insert 14 to be placed therein, as will be described in greater detail below. A benefit of using a curved outer surface 50 is that the curved surface 50 permits the material cut by the cutting bit insert 14 to be directed past the ring 16 more easily than if a more angular configuration were used.

The ring 16 is made from a second material which is a particular blend of tungsten carbide different from that used for the cutting bit insert 14. The preferred composition for the ring 16 includes about 85.5% tungsten carbide, about 11% cobalt, and about 0.5% tantalum carbide, by weight. This composition is preferably made from a mixed grain, non-homogenous distribution having an average grain size between about 2.2 microns and about 6.6 microns. This combination gives a grade of carbide which has a hardness of about 87.5 Ra, a density of about 14.3 grams per cubic centimeter, a TRS of about 2200 Newtons per square millimeter, and giving a porosity of about A04, B00, C00. These characteristics are preferred for the material for the ring 16.

Figure 2:
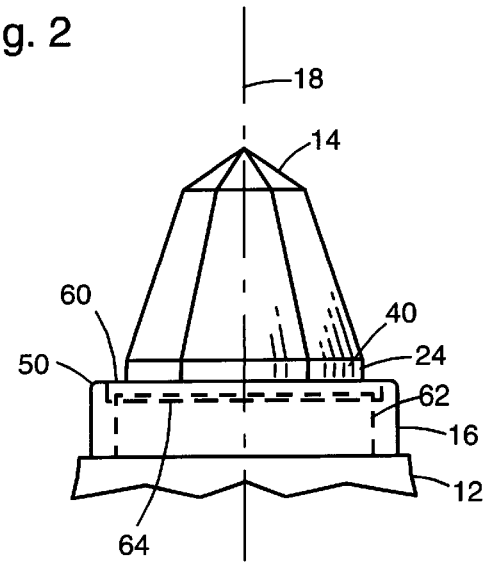
FIG. 2 is an enlarged view of FIG. 1 focusing on the cutting bit insert and ring and a part of the shank.
Figure 3:
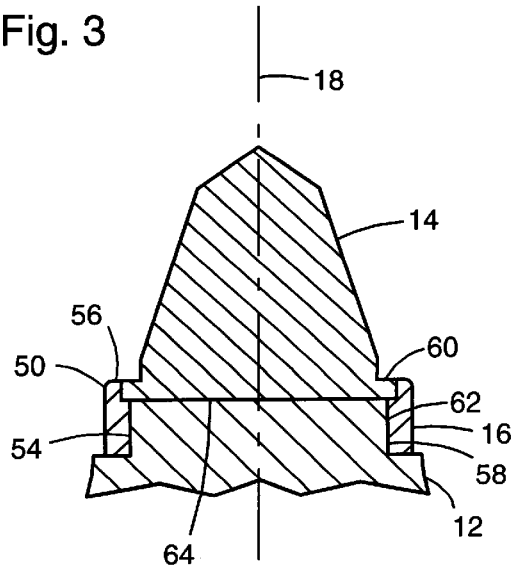
FIG. 3 is a cross-sectional view of cutting bit insert, ring, and shank as shown in FIG. 2.

How the characteristics of the cutting bit insert 14 and ring 16 work together to enhance the cutting and durability properties of the cutting tool 10 is seen more clearly in FIGS. 2 and 3. As is seen in these FIGS., the cutting bit insert 14 includes a body 19 as previously described and a flange 60 (best seen in FIG. 3). The flange 60 extends outwardly from the faces 40 of the third portion 24. As mentioned above, the number of portions which make up the body 19 can vary. Regardless of the number of portions, the flange 60 extends outwardly from the faces of the portion furthest from the vertex 30, which is the second end 64 of the cutting bit insert 14. The flange 60 is preferably integrally formed with the body 19 for reasons of strength.

The ring 16 is placed to surround or in surrounding relationship with the flange 60. The upper portion 56 of the bore 54 in the ring 16 preferably closely fits the flange 60. The shank 12 includes a neck 62 which extends away from one side of the shank 12. The neck 62 fits within the lower portion 58 of the bore 54 and the neck 62 is slightly smaller than the second end 64 of the cutting bit insert 14, which is generally placed adjacent the neck 62 in the bore 54, as best seen in FIG. 3. The cutting bit insert 14 and ring 16 are independently secured to the shank 12, most preferably by simultaneously brazing the cutting bit insert 14 and ring 16 to the neck portion 62 of the shank 12. The ring 16 and cutting bit insert 14 may also be secured to each other.

This configuration of the cutting bit insert 14, ring 16, and shank 12 enhances the performance of the cutting tool 10 in other ways as well. In particular, the use of this configuration of elements requires the cutting bit insert 14 to be substantially centered on the shank 12 by substantially requiring the cutting bit insert 14 and shank 12 to share a common longitudinal axis 18. Because of the relatively close fit of the bore 54 to each of the shank 12 and the second end 64 of the cutting bit insert 14, the cutting bit insert 14 is properly aligned on the shank 12 through the insertion of the cutting bit insert 14 into the upper portion 56 of the bore 54 and the placement of lower portion 58 of the bore 54 around the neck 62 on the shank 12. The proper alignment of the cutting bit insert 14 and shank 12 permits a smooth rotation of the cutting tool 10 and therefore a more even cutting action on the material or surface to be removed.

It is also important that the ring 16 and cutting bit insert 14 be made as separate parts. Because the parts have different purposes, they are preferably made from different materials, which is more easily accomplished when the parts are made separately. A purpose of the ring 16 is to prevent the passive wear of the shank 12 caused by loose cut material flowing along the sides of the cutting bit insert 14. However, for optimal cutting by the cutting bit insert 14, a certain degree of hardness is required. However, if the ring 16 is made from a material which is as hard as or harder than the material needed for the cutting bit insert 14 as taught in the prior art, it has been discovered that the ring 16 fails to satisfactorily channel the loose material away from the bit insert 14 and shank 12 and that the ring 16 is also more likely to break. If either of these circumstances occur, the wear of the shank 12 is increased, which is not a desirable result. The ring 16 is therefore preferably made from a softer material than the cutting bit insert 14 in order to increase the durability of the cutting tool 10 as a whole. Thus, the ring 16 and cutting bit insert 14 are made of different compositions of materials wherein the cutting bit insert 14 is harder than the ring 16.

The positioning of the ring 16 with respect to the cutting bit insert 14 is also related to the sloping mentioned earlier in connection with the faces of the cutting bit insert 14. The sloping of the faces begins at a relatively large angle, as $\alpha$, at the vertex 30, then decreases to a very small or zero at the last portion of the cutting bit insert 14, as $\gamma$. The curved surface 50 on the ring 16 is a continued sloping from the faces of the cutting bit insert 14. Thus, this configuration enhances the flow of loose material from the cutting bit insert 14 and past the ring 16 to divert the material from the shank 12, thus decreasing the wear on the shank 12. While the preferred cutting bit insert 14 with which this configuration of ring 16 is used is the octagonal cutting bit insert 14 shown, a configuration of any similar, but non-octagonal or non-pyramid-shaped, cutting bit may be used with the present ring as long as the other types of properties mentioned above as desirable are maintained.

While certain preferred embodiments of the present invention have been disclosed in detail, it is to be understood that various modifications may be adopted without departing from the spirit of the invention or scope of the following claims.

What is claimed is:

1. A cutting bit insert for fixing to a rotable shank, comprising first and second portions configured in a polygonal pyramid shape and provided with a selected number of faces, adjacent ones of the faces meeting at a common edge, the edges intersecting at a vertex to form one end of the cutting bit, the faces of the first portion sloping away from the vertex at a first angle relative to a longitudinal axis of the cutting bit, and the faces of the second portion sloping away from the first portion at a second angle relative to the longitudinal axis.

2. A cutting bit insert according to claim 1, further comprising a flange which extends outwardly from the faces of one of the first or second portions.

3. A cutting bit insert according to claim 2, further comprising a ring mounted in surrounding relationship to the flange.

4. A cutting bit insert according to claim 3, wherein the cutting bit has a first hardness and the ring has a second hardness lower than the first hardness.

5. The cutting bit insert according to claim 1, wherein the polygonal pyramid is octagonal.

6. The cutting bit insert according to claim 1, further comprising a third portion configured in the polygonal pyramid shape and provided with the selected number of faces, the faces of the third portion sloping away from the second portion at a third angle relative to the longitudinal axis.

7. A cutting bit insert according to claim 6, further comprising a flange which extends outwardly from the faces of the third portion.

8. A cutting bit insert according to claim 7, further comprising a ring mounted in surrounding relationship to the flange.

9. A cutting bit insert according to claim 8, wherein the cutting bit has a first hardness and the ring has a second hardness lower than the first hardness.

10. A cutting tool, comprising:

(a) a shank;

(b) a cutting bit insert mounted to the shank and having a first hardness and including an outwardly extending flange; and (c) a ring having a second hardness lower than the first hardness and mounted in surrounding relationship to a portion of the shank and the flange, the ring having a central bore which has two portions with different diameters, the larger of said diameters surrounds the flange and being disposed above said smaller diameter, thereby causing the insert to be centered on an axis of rotation of the shank.

11. The cutting tool according to claim 10, wherein the cutting bit insert includes first and second portions configured in a polygonal pyramid shape provided with a selected number of faces, adjacent ones of the faces meeting at a common edge, the edges intersecting at a vertex on the first portion, the faces of the first portion sloping away from the vertex at a first angle relative to the longitudinal axis, and the faces of the second portion sloping away from the first portion at a second angle relative to the longitudinal axis.

12. The cutting tool according to claim 11, wherein the polygonal pyramid is octagonal.

13. A cutting tool, comprising:

(a) a shank;

(b) a cutting bit insert mounted to the shank and having a first hardness, the cutting bit insert having first and second portions configured in a polygonal pyramid shape provided with a selected number of faces, adjacent ones of the faces meeting at a common edge, the edges intersecting at a vertex to form one end of the cutting bit insert, the faces of the first portion sloping away from the vertex at a first angle relative to the longitudinal axis, and the faces of the second portion sloping away from the first portion at a second angle relative to the longitudinal axis, and a flange extending outwardly from the second portion; and (c) a ring mounted in surrounding relationship to the flange and having a second hardness lower than the first hardness.

14. The cutting tool according to claim 13, wherein the polygonal pyramid is octagonal.

* * * * *